United States Patent [19]

Kempf

[11] 4,410,397

[45] Oct. 18, 1983

[54] DELIGNIFICATION AND BLEACHING PROCESS AND SOLUTION FOR LIGNOCELLULOSIC PULP WITH PEROXIDE IN THE PRESENCE OF METAL ADDITIVES

[75] Inventor: Arthur W. Kempf, Warwick, N.Y.

[73] Assignee: International Paper Company, New York, N.Y.

[21] Appl. No.: 220,162

[22] Filed: Dec. 24, 1980

Related U.S. Application Data

[63] Continuation of Ser. No. 48,651, Jun. 14, 1979, abandoned, which is a continuation of Ser. No. 894,605, Apr. 7, 1978, abandoned.

[51] Int. Cl.[3] ..... D21C 9/16

[52] U.S. Cl. ..... 162/78; 162/79; 423/273

[58] Field of Search ..... 162/78, 79; 8/111; 252/186.27, 186.28, 186.33, 186.38, 186.41; 423/273

[56] References Cited

U.S. PATENT DOCUMENTS

| | | | |
|---|---|---|---|
| 396,325 | 1/1899 | Brin et al. . | |
| 1,213,921 | 1/1917 | Liebknecht et al. | 8/111 |
| 1,758,920 | 5/1930 | Baum | 252/186 |
| 1,760,042 | 5/1930 | Crespi et al. . | |
| 1,957,937 | 5/1934 | Campbell et al. . | |
| 1,958,204 | 5/1934 | Reichert | 252/186 |
| 2,004,809 | 6/1935 | Gilbert et al. | 252/186 |
| 2,081,327 | 5/1937 | Franz . | |
| 2,112,116 | 3/1938 | Richter . | |
| 2,119,519 | 6/1938 | Bragg . | |
| 2,173,474 | 9/1939 | Evoy . | |
| 2,187,016 | 1/1940 | Craig . | |
| 2,249,646 | 7/1941 | Bragg . | |
| 2,368,527 | 1/1945 | Edelstein . | |
| 2,413,583 | 12/1946 | Shearer | 162/78 |
| 2,466,633 | 4/1949 | Brabender et al. . | |
| 2,975,169 | 3/1961 | Cranford et al. . | |
| 3,023,140 | 2/1962 | Textor . | |
| 3,049,394 | 8/1962 | Wolinski . | |
| 3,149,906 | 9/1964 | Thorsen . | |
| 3,156,654 | 11/1964 | Konecny et al. . | |
| 3,193,445 | 7/1965 | Parker et al. . | |
| 3,251,731 | 5/1966 | Gard | 162/78 |
| 3,318,657 | 5/1967 | Wade . | |
| 3,352,642 | 11/1967 | Heidt et al. . | |
| 3,451,888 | 6/1969 | Ancelle et al. . | |
| 3,462,344 | 8/1969 | Kindron et al. . | |
| 3,652,387 | 3/1972 | Wilder . | |
| 3,652,388 | 3/1972 | Croon et al. . | |
| 3,663,357 | 5/1972 | Liebergott . | |
| 3,806,404 | 4/1974 | Liebergott et al. . | |
| 3,829,357 | 8/1974 | Thompson et al. . | |
| 3,980,517 | 9/1976 | MacTaggart . | |
| 4,022,654 | 5/1977 | Engstrom et al. . | |
| 4,080,249 | 3/1978 | Kempf et al. . | |

FOREIGN PATENT DOCUMENTS

| | | | |
|---|---|---|---|
| 902861 | 6/1972 | Canada . | |
| 966604 | 4/1975 | Canada . | |
| 970111 | 7/1975 | Canada . | |
| 2040763 | 11/1971 | Fed. Rep. of Germany . | |
| 2649633 | 5/1977 | Fed. Rep. of Germany . | |
| 1369662 | 9/1963 | France . | |
| 344054 | 8/1972 | U.S.S.R. . | |
| 699064 | 11/1979 | U.S.S.R. | 162/78 |

OTHER PUBLICATIONS

P. K. Christensen, "Bleaching Sulphate Pulp With Hydrogen Peroxide", *Pulp and Paper Magazine of Canada*, 73, 62–66; (Oct. 1973).

P. K. Christensen, "Bleaching of Sulphate Pulps With Hydrogen Peroxide", *Norsk Skogindustri*, 268–271 (Oct. 1973).

M. G. Delattre, "Hydrogen Peroxide As A Bleaching Agent For Kraft Pulps", *Papper och Tra*, 117–127 (1971).

N. Hartler et al., "Peroxide Bleaching of Kraft Pulps", *Tappi*, 43, 806–813 (Oct. 1960).

P.C. Holladay et al., "The Bleaching of Pulp", Chapter 9, 180–185, Mack Printing Company (1963).

J. Hook, "Peroxide Bleaching Opens New Potentials for Groundwood Pulp", *Pulp & Paper International*, 45–48 (Jun. 1975).

N. Liebergott, "Paprizone treatment—A New Technique for Brightening And Strengthening Mechanical Pulps", Pulp and Paper Magazine of Canada, 73 (Sep. 1972).

N. Liebergott, "Sequential Treatment of Mechanical Pulps At High Consistency With $H_2O_2$ and $O_3$—The Paprizone Process—Effect On Pulp Brightness And Strength", *Pulp and Paper Magazine of Canada*, 73, 70–73 (Sep. 1972).

McCloskey et al., "Catalytic Influence of Iron and Magnesium Ions In Oxygen Bleaching Reactions", *Tappi*, 58, 56–59 (Feb. 1975).

C. Mlakar et al., "Peroxide In The Semibleaching Of Kraft Pulp", *Papper och Tra*, 629–638 (1968).

F. Pancirolli, "Sulphate Pulp Bleaching Tests With Ozone", (1935).

W. H. Rapson, "The Role of pH In Bleaching Pulp", *Tappi*, 39, 284–294 (May 1956).

S. Rothenberg et al., "Bleaching Of Oxygen Pulps With Ozone", *Tappi*, 58, 182–185 (Aug. 1975).

Schumb et al., "Hydrogen Peroxide", ACU Monograph S.N. 128, Reinholt Pub., New York, Chapter 12, pp. 658–661 (1955).

N. Soteland, "Bleaching Of Chemical Pulps With Ozone And Oxygen", *Pulp and Paper Magazine of Canada*, 75, T153–T158 (Apr. 1974).

N. Soteland, "The Effect Of Ozone On Mechanical Pulps", *Norsk Skogindustri*, 165–169 (Jun. 1974).

V. Vartiainen, "Utilization Of Peroxide In Pulp Bleaching", *Papper och Tra*, 51, 277–279 and 281–284 (1969).

J. G. Wallace, "Hydrogen Peroxide In Organic Chemistry", pp. 60–69 (1950).

*Primary Examiner*—William F. Smith

*Attorney, Agent, or Firm*—James F. Haley, Jr.; Robert M. Shaw

[57] ABSTRACT

An improved peroxide based brightening and delignifying solution and process for liqnocellulosic pulp, characterized by selective delignification and pulp viscosity retention is disclosed. The process comprises maintaining a pulp slurry to a temperature between 40° C. and 120° C. for 0.5 hours to 8 hours. The slurry comprises lignocellulosic pulp; from 0.1% to 20% by weight based on O.D. pulp of peroxide; from 0.1% to 10% by weight based on O.D. pulp of a metal-containing additive whose metallic portion is selected from the group consisting of tin, titanium, and vanadium; and sufficient acid to maintain the pH of the slurry between about 1 and about 7. In a preferred embodiment of this invention, a tin additive is employed and the partially delignified and brightened pulp is further bleached with the unconsumed peroxide by adjusting the pH of the slurry to between 8 and 12 and maintaining the temperature of the slurry from 40° C. to 90° C. for 0.1 to 4 hours.

23 Claims, No Drawings

DELIGNIFICATION AND BLEACHING PROCESS AND SOLUTION FOR LIGNOCELLULOSIC PULP WITH PEROXIDE IN THE PRESENCE OF METAL ADDITIVES

This is a continuation of application Ser. No. 48,651, filed June 14, 1979, abandoned, which itself is a continuation of application Ser. No. 894,605, filed Apr. 7, 1978, abandoned.

BACKGROUND OF THE INVENTION

This invention relates to an improved process for delignifying and brightening lignocellulosic pulp. More particularly, the invention is directed at a peroxide-based delignifying and bleaching solution and process for lignocellulosic pulp. In this process, an aqueous peroxide solution of pH 1–7 is activated by the presence of certain metal containing additives whose metallic portions are selected from the group consisting of tin, titanium, and vanadium to delignify and brighten lignocellulosic pulp with minimal destruction of the cellulosic portion of the pulp. In a second aspect of this invention, these peroxide residuals remaining after tin activated delignification are consumed, following alkaline pH adjustment, in the further bleaching of the lignocellulosic pulp.

Wood is composed of two main parts—a fibrous carbohydrate or cellulosic portion and a non-fibrous portion comprising a complex chemical, commonly referred to as lignin.

For use in paper-making processes, wood must first be reduced to pulp, which can be defined as wood fibers capable of being slurried or suspended and then deposited as a screen to form a sheet. The methods employed to accomplish this pulping usually involve either a physical or chemical treatment of the wood or perhaps some combination of the two processes, to alter its chemical form to give desired paper properties.

In mechanical pulping, the wood is physically ground to a high-yield, lignin-retained pulp, most often referred to as groundwood pulp. In chemical pulping, the wood chips are digested with chemical solutions to solubilize a portion of the lignin and effect its removal. The more usual of these digestive procedure are the sulfite, sulfate or Kraft, soda and modified sulfite processes.

After the wood has been digested or mechanically ground, the resulting material is generally a darkly colored cellulosic fiber. The dark color is attributable to the fact that not all of the lignin has been removed during digestion and substantially none has been removed during mechanical processing. This dark pulp is commonly referred to as unbleached pulp. It may pass directly to the paper making operation if the paper color is unimportant.

More usually, the unbleached lignocellulosic pulps are bleached or brightened to a brightness consistent with the planned utilization of the pulp, brightness being a measure of pulp reflectivity under standardized conditions. Pulp bleaching is most often a multi-stage process employing various chemicals to remove or alter the lignin of the lignocellulosic pulp such that the resultant pulp is no longer light absorbing or dark in color.

Two classes of compounds generally find use as lignocellulosic brighteners, namely reducing agents and oxidizing agents. Common reducing agents include sulfurous acids, hydrosulphites, borohydrides, amine boranes, and bisulfites. Common oxidizing agents include chlorine-based compounds, peroxides, peracids, ozone, oxygen, permanganates and chromates.

The ready availability and environmentally appealing nature of hydrogen peroxide has made it increasingly popular in recent years in the paper-making industry. Such peroxide is used in the "lignin retaining" bleaching of groundwood and other high yield pulps to provide substantial brightness gains but not the high brightness attainable with chemical pulps. Such processes are described for example in Hook, "Peroxide Bleaching Opens New Potentials For Groundwood Pulps", *Pulp & Paper International,* 45–48 (June 1975), Vartiainen, "Utilization of Peroxide in Pulp Bleaching", *Papper och Tra,* 51, 277–284 (1969), U.S. Pat. Nos. 2,187,016, 3,023,140, and 3,251,731 and Canadian Pat. No. 970,111. Additionally, peroxides are employed as a "capping" or super-bleach stage at the end of common multi-stage bleaching processes for chemical pulps. Exemplifying these processes are those described in Canadian Pat. Nos. 966,604 and 970,111, U.S. Pat. Nos. 3,193,445 and 3,462,344 and Vartiainen, "Utilization of Peroxide in Pulp Bleaching", *Papper och Tra,* 51, 277–284 (1969), Delattre, "Hydrogen Peroxide as a Bleaching Agent for Kraft Pulps", *Papper och Tra,* 117–127 (1971), Hartler et al., "Peroxide Bleaching of Kraft Pulps", *Tappi,* 43, 806–813 (1960), Christensen, "Bleaching Sulphate Pulp With Hydrogen Peroxide", *Pulp and Paper Magazine of Canada,* 62–66 (1971), Christensen, "Bleaching of Sulphate Pulps With Hydrogen Peroxide", *Norsk Skogindustri,* 268–271 (October, 1973), and Mlakar & Peltonen, "Peroxide in the Semibleaching of Kraft Pulp", *Papper och Tra,* 11, 629–638 (1968).

However, such peroxide bleaching by itself is not able to effect sufficient pulp bleaching for most paper-making requirements. Previous variations of the conditions of such peroxide contact have either not remedied this inferior bleaching characteristic or have so degraded the cellulosic portion of the pulp that it was no longer useful for paper-making processes.

For example, at acid pH, brightness levels obtained are inferior to those from peroxide bleachings on the alkaline side. E.g., Rapson, "The Role of pH in Bleaching Pulp", Tappi, 39, 284–294 (1956). Moreover, absent special low temperature impregnation and drying procedures disclosed in U.S. Pat. No. 2,173,474, acid solutions of hydrogen peroxide effect marked deterioration of the pulp in both strength and viscosity. E.g., U.S. Pat. No. 2,112,116. Similar pulp viscosity reductions adduced by the addition of metals such as manganese, cobalt, iron, copper, and aluminum to oxidizing bleaching agents such as peroxide have been used to good advantage in U.S. Pat. Nos. 2,975,169 and 2,368,527 to produce pulp, which, while unsuitable for paper manufacture, is well constituted for the production of viscose rayon or other cellulose-like derivatives.

Other additives are likewise ineffective in improving the brightness gain possible with a single-staged hydrogen peroxide. For example, U.S. Pat. Nos. 2,119,519 and 2,249,646 disclose the addition of titanium having a valence of less than four to oxidizing bleaching agents, including peroxides. Such addition is said to activate the *alkaline* bleaching process so as to reduce both the treatment time and oxidant concentration needed to obtain a given level of brightness gain. These reductions advantageously benefit pulp strength since viscosity losses and other pulp degradation are minimized due to abbreviated oxidant-pulp contact.

The failure of hydrogen peroxide to bleach pulp in an internal or prebleaching stage to a substantial degree of brightness is apparently due to the inability of peroxide to delignify lignocellulosic pulps sufficiently to remove the light-absorbing, dark lignin components and yet, to maintain that resultant pulp viscosity and strength necessary for subsequent paper making processes.

SUMMARY OF THE INVENTION

It is accordingly an object of this invention to provide a bleaching solution and process whereby peroxide may be employed to delignify selectively and brighten lignocellulosic pulp yet retard that pulp viscosity loss and degradation caused by cellulose oxidation.

Another object of this invention is to provide a peroxide based delignifying solution and process characterized by minimal consumption of hydrogen peroxide.

A further object of this invention is to provide a method wherein lignocellulosic pulp delignified and brightened in one process according to this invention may be further bleached in alkaline solution by that peroxide remaining unconsumed in the delignification.

These and other additional objects and advantages of this invention, apparent from the detailed description and claims which follow, are accomplished in accordance with this invention at about 40° C. to about 120° C. in an aqueous slurry comprising a lignocellulosic pulp; about 0.1% to about 20.0%, based on O.D. (oven-dried) pulp, of a peroxide; from about 0.1% to about 10% by weight, based on O.D. pulp, of a metal-containing additive whose metallic portion is selected from the group consisting of tin, vanadium and titanium; and sufficient acid to maintain the pH of said slurry between about 1 and about 7.

Additionally, in the preferred embodiment wherein tin activation is had, this delignification and brightening is followed in sequence by adding sufficient base to the pulp slurry to adjust its pH to between about 8 and about 12 and continuing the bleaching or brightening of the pulp with the, now alkaline, tin-containing peroxide solution.

DETAILED DESCRIPTION OF THE INVENTION

This invention relates to a peroxide-based solution and process for selectively delignifying and brightening lignocellulosic pulp. It avoids attacking the cellulosic portion of the pulp so as not to degrade the pulp and reduce its viscosity to levels below those acceptable for paper-making processes. According to this invention, wood pulps and other lignocellulosic pulps may be utilized to good advantage. By way of example, preferred lignocellulosic pulps include those wood pulps digested by the well-known sulfite, sulfate or Kraft, soda and modified sulfite processes. The process is particularly useful for the bleaching of Kraft pulps especially those which have been semi-bleached with conventional oxygen bleaching stages. Such semi-bleaching is disclosed, for example, in Soteland, "Bleaching of Chemical Pulps with Oxygen and Ozone", *Pulp and Paper Magazine of Canada,* 75, T153–158 (1974).

The novel delignifying and brightening process of this invention comprises maintaining the temperature of an aqueous pulp slurry between about 40° C. and about 120° C. and more preferably between about 60° C. and 100° C. for a period of between about 0.5 hours to about 8 hours, said pulp slurry comprising: lignocellulosic pulp; from about 0.1% to about 20% by weight, based on O.D. pulp, of peroxide; from 0.1% to about 10% by weight, based on O.D. pulp, of a metal-containing additive whose metallic portion is selected from the group consisting of tin, titanium and vanadium; and sufficient acid to maintain the pH of said pulp slurry between about 1 and about 7. It should, of course, be understood that any selection of specific conditions within these possible ranges must be in accordance with ordinary skill in the art. For example, a choice of 120° C. and pH 1 for 8 hours is not recommended and would be likely to destroy the pulp. Yet, a treatment time of 0.5 hours under these conditions could be used to good effect in the practice of this invention.

The methodology for carrying out this process in the pulp slurry is conventional in the art. Most commonly, slurries of consistency from about 3% to about 50%, and more preferably 10% to 35% are employed. The time of reaction is not critical but to preserve pulp viscosity it is usually below 8 hours in duration and most preferably between 2 and 4 hours.

Preferably, the pulp is not placed in contact with peroxide at low pH and elevated temperatures in the absence of metal additive. Therefore, the metal additive may be mixed with the pulp before the peroxide is added or added simultaneously with the peroxide to the pulp. Other addition methods to avoid pulp-peroxide contact at low pH and elevated temperature in the absence of metal additive may be readily envisioned.

The peroxide used in the process of this invention may be obtained from any number of conventional sources. These include inorganic peroxides such as sodium peroxide, organic peroxides, and aqueous solutions of hydrogen peroxide itself, the latter being preferred. The chosen peroxide or a mixture thereof may be used in about 0.1% to about 20% by weight, based on O.D. pulp, but preferably is present between 0.5 and 2% by weight.

The peroxide stabilizers taught in the art to slow deleterious auto-decomposition of peroxide during bleaching are not needed in the slurries of this invention. Instead, the metallic additives of this invention appear both to stabilize the peroxide and activate its selective oxidative attack on the lignin of the lignocellulosic pulp.

The metal containing additives, whose metallic portions are selected from the group consisting of tin, vanadium and titanium, may be selected from a wide range of such compounds. Examples of useful compounds of this type include sodium stannate, vanadium pentoxide, titanium sulfate, stannous sulfate, and stannous chloride. Tin-containing additives are preferred. Although it is not necessary that the chosen additive be totally soluble under the conditions of this invention, such dissolution is usual and preferred.

To maintain the pH of the slurry between about 1 and about 7, and more preferably between about 3 and 5, any of a varied number of conventional acid and buffer solutions may be used. These include sulfuric acid, hydrochloric acid, phosphoric acid, acetic acid, and formic acid.

Following the selective delignification and brightening of this invention, the lignocellulosic pulp may be washed in a conventional manner or additionally treated in any number of well-recognized, paper-making processes. The filtrate is able to be refortified with peroxide or recycled in a conventional manner for further use in pulp bleaching sequences. However, one surprising attribute of the process of this invention is the minimized consumption of peroxide therein when tin additives are employed. Hence, it is preferred that this remaining peroxide be employed to further bleach and brighten the now partially delignified pulp. In a second aspect of this invention this further bleaching is obtained by adding sufficient alkali to the pulp slurry to adjust its pH to between about 8 and 12 and more preferably between about 9 and 10.5. The alkali used to adjust the pH of the slurry may be selected from any of the bases well recognized as being useful in alkaline pulp bleaching processes. Its specific selection plays no part in this invention. Using conventional bleaching procedures, good pulp brightening is effected by this alkaline slurry of pulp, peroxide and tin additive at temperatures between about 40° C. and 90° C. and more preferably between about 50° C. and about 70° C. Again no conventional peroxide stabilizers need be added; the tin additive apparently stabilizing the alkaline peroxide. The reaction time is not critical. Usually, between 0.1 and 4 hours is sufficient to consume most of the peroxide.

Alternatively, instead of making the acidic peroxide-tin solution alkaline, the solution including unused peroxide values may be separated from the bleached pulp fibers and recycled to treat additional unbleached pulp.

In order to describe the present invention so that it may be more clearly understood, the following examples are set forth. These examples are primarily for the purpose of illustration and any specific enumeration therein should not be construed as a limitation on the concept of this invention.

In the following examples, a hardwood pulp was pulped via a conventional Kraft process and semi-bleached by a conventional oxygen bleaching process.

EXAMPLE I

An aqueous solution of hydrogen peroxide was prepared and the solution adjusted to pH 3 by the addition of sulfuric acid. Sufficient oxygen-bleached hardwood Kraft pulp was added to this peroxide solution to attain a pulp consistency of 10% and a 1.0% by weight, based on O.D. pulp, hydrogen peroxide content. This acid slurry was divided into two portions IA and IB. They were heated for four hours at 50° C. and 77° C. respectively. The results are shown in Table I which follows Example II.

EXAMPLE II

An aqueous solution of hydrogen peroxide and sodium stannate was prepared and the pH adjusted to 3.0 by sulfuric acid addition. Sufficient oxygen-bleached hardwood Kraft pulp was added to this solution to attain a pulp consistency of 10%, a 1% by weight, based on O.D. pulp, hydrogen peroxide content and a 1% by weight, based on O.D. pulp, sodium stannate content. This slurry was divided into two portions, II-A and II-B. These were heated for four hours at 50° C. and 77° C., respectively. The results appear in Table I.

TABLE I

| Ex. | Sodium Stannate (%) | Temperature (°C.) | Residual Peroxide (%) | Permanganate Number | Viscosity (cp) | Brightness (% EL) |
|---|---|---|---|---|---|---|
| | Oxygen Bleached Starting Pulp - | | | 6.7 | 24.3 | 46.6 |
| IA | 0.0 | 50° | 0.27 | 6.0 | 16.6 | 56.8 |
| IIA | 1.0 | 50° | 0.29 | 6.1 | 27.5 | 55.6 |
| IB | 0.0 | 77° | 0.00 | 4.4 | 7.9 | 57.8 |

TABLE I-continued

| Ex. | Sodium Stannate (%) | Temperature (°C.) | Residual Peroxide (%) | Permanganate Number | Viscosity (cp) | Brightness (% EL) |
|---|---|---|---|---|---|---|
| IIB | 1.0 | 77° | 0.31 | 5.1 | 24.6 | 56.2 |

These comparative results exhibit the pulp viscosity retaining characteristic of this invention. Moreover, the brightness improvement and minimized peroxide consumption is depicted.

EXAMPLE III

An aqueous solution of hydrogen peroxide was prepared and the pH adjusted to 4.0 by sulfuric acid addition. Sufficient oxygen-bleached, hardwood Kraft pulp was added to this solution to attain a pulp consistency of 4.0% and a 2.0% by weight, based on O.D. pulp, hydrogen peroxide content. This slurry was heated for 1 hour at 120° C. The results of this reaction are illustrated in Table II, which follows Example VI.

EXAMPLE IV

An aqueous solution of hydrogen peroxide and sodium stannate was prepared and the pH adjusted to 4.0 by sulfuric acid addition. Sufficient oxygen-bleached, hardwood Kraft pulp was added to this solution to attain a pulp consistency of 4% and a 2% by weight, based on O.D. pulp, hydrogen peroxide and 1% by weight, based on O.D. pulp, sodium stannate. The slurry was heated for 1 hour at 120° C. The results of this reaction are illustrated in Table II, which follows Example VI.

EXAMPLE V

A similar procedure to that of Example III was followed except that the pH of the peroxide solution was adjusted to pH 6 before pulp admixture. The results are illustrated in Table II, which follows Example VI.

EXAMPLE VI

A similar procedure to that of Example IV was followed except the pH of the peroxide-stannate solution was adjusted to pH 6 before pulp admixture. The results are illustrated in Table II.

TABLE II

| Ex. | Sodium Stannate (%) | pH | Permanganate Number | Viscosity (cp) | Brightness (% EL) |
|---|---|---|---|---|---|
| | Oxygen Bleached Starting Pulp | | 6.5 | 19.5 | 47.7 |
| III | 0.0 | 4 | 2.0 | 3.9 | 54.9 |
| IV | 1.0 | 4 | 1.7 | 8.2 | 64.4 |
| V | 0.0 | 6 | 2.0 | 4.3 | 53.1 |
| VI | 1.0 | 6 | 3.4 | 8.3 | 67.1 |

Once again, the pulp was substantially brightened, and yet the viscosity was maintained, by treatment in accordance with this invention.

EXAMPLE VII

The same oxygen-bleached, hardwood pulp employed in Examples III–VI was treated in accordance with the procedures of Example I except the reaction temperature was 90° C. The results are illustrated in Table III, which follows Example VIII.

EXAMPLE VIII

The same oxygen-bleached, hardwood pulp employed in Examples III–VI was treated in accordance with the procedures of Example II except that only 0.5% metal additive was included and the reaction temperature was 90° C. Various metal additives were employed; sodium stannate (A), stannous sulfate (B), vanadium pentoxide (C), and titanium sulfate (D). The results are illustrated in Table III.

TABLE III

| Exs. | Residual Peroxide (%) | Permanganate Number | Viscosity (cp) | Brightness (% EL) |
|---|---|---|---|---|
| | Oxygen Bleached Starting Pulp | 6.5 | 19.5 | 47.7 |
| VII | 0.33 | 4.0 | 6.0 | 56.8 |
| VIII-A | 0.83 | 3.6 | 14.0 | 59.1 |
| VIII-B | 0.60 | 3.2 | 10.7 | 57.8 |
| VIII-C | 0.01 | 3.2 | 9.1 | 57.3 |
| VIII-D | 0.00 | 2.4 | 9.7 | 61.3 |

These results illustrate the usefulness of a variety of metal additives in this invention. They also display the preference for tin additives due to their peroxide-retaining behavior.

EXAMPLE IX

A tin compound, either sodium stannate or stannous sulfate, was mixed with an aqueous hydrogen peroxide solution and the pH of that solution adjusted to 3.0 with sulfuric acid. Sufficient oxygen-bleached, hardwood Kraft pulp was mixed with this solution to give a number of slurries of 10% consistency containing 2.0% hydrogen peroxide and either 0.5% or 1.0% tin compound by weight based on O.D. pulp. The slurries were again adjusted to pH 3.0 with sulfuric acid and heated at 90° C. for the reaction times specified in Table IV.

After this reaction, the pulp slurries were adjusted to about pH 9 with sodium carbonate and, at continued 10% consistency, heated for two hours at 60° C. The resulting pulp was washed with distilled water. The results of this series of reactions are illustrated in Table IV.

TABLE IV

| Ex. | pH* | Time* (Hrs.) | Tin Additive (%) | Residual Peroxide (%) | Permanganate Number | Viscosity (cp) | Brightness (% EL) |
|---|---|---|---|---|---|---|---|
| | Oxygen Bleached Starting Pulp | | | | 6.5 | 19.5 | 47.7 |
| IX-1 | 3.0/— | 24/— | sodium stannate 1.0 | 0.95/— | 2.0 | 3.4 | 60.3 |
| IX-2 | 3.0/— | 4/— | sodium stannate 0.5 | 0.58/— | 3.5 | 9.9 | 62.1 |
| IX-3 | 3.0/9.0 | 4/2 | sodium stannate 1.0 | ND**/0.373 | 2.3 | 11.8 | 70.2 |
| IX-4 | 3.0/8.9 | 4/2 | stannous sulfate 1.0 | ND**/0.123 | 2.6 | 12.8 | 71.6 |

*First Stage/Second Stage.
**not determined.

Therefore, the preferred sequential process of this invention adduces superior bleaching and good peroxide utilization as compared to even a one-stage extended treatment. Moreover, such extended single stage treatment fails to sufficiently preserve the viscosity of the pulp.

While I have hereinabove presented a number of embodiments of my invention, it is apparent that my basic construction can be altered to provide other embodiments which utilize my invention. Thus, it will be appreciated that the scope of my invention is to be defined by the claims appended hereto rather than the specific embodiments which have been presented hereinbefore by way of example.

I claim:

1. A process for delignifying and brightening lignocellulosic pulp for use in a paper-making process, comprising forming an aqueous acidic slurry of lignocellulosic pulp having a pulp consisting of 3% to 50% and maintaining the temperature of the pulp slurry between about 40° C. and about 120° C. for a period of between about 0.5 hours and about 8 hours to delignify and brighten the pulp while substantially avoiding the pulp viscosity loss and degradation from cellulose oxidation, said pulp slurry consisting essentially of lignocellulosic pulp; from about 0.1% to about 20% by weight, based on O.D. pulp, of peroxide; from about 0.1% to about 10% by weight, based on O.D. pulp, of a metal-containing additive whose metallic portion is selected from the group consisting of tin, titanium and vanadium; and sufficient acid to maintain the pH of the pulp slurry between about 1 and about 7.

2. The process of claim 1 wherein the temperature of said pulp slurry is maintained between about 60° C. and about 100° C. for a period of between about 2.0 and 4.0 hours.

3. The process of claim 1 wherein said peroxide is present in said pulp slurry in an amount between about 0.5% and about 2% by weight based on O.D. pulp.

4. The process of claim 1 wherein said peroxide is hydrogen peroxide.

5. The process of claim 1 wherein said metallic portion is tin and is present in said pulp slurry in an amount between about 0.5% and about 2% by weight based on O.D. pulp.

6. The process of claim 5 wherein said pulp is separated from said slurry and the filtrate therefrom recycled to delignify and bleach additional lignocellulosic pulp.

7. The process of claim 1 wherein the pH of said pulp slurry is maintained between about 3 and about 5.

8. In a process for delignifying and brightening lignocellulosic pulp for use in a paper-making process, the improvement comprising employing an aqueous acidic slurry of lignocellulosic pulp having a pulp consisting of 3% to 50% and consisting essentially of lignocellulosic pulp; from about 0.1% to about 20% by weight, based on O.D. pulp, of peroxide; from about 0.1% to about 10% by weight, based on O.D. pulp, of a metal-containing additive whose metallic portion is selected from the group consisting of tin, titanium and vanadiam; and sufficient acid to maintain the pH of the pulp slurry between about 1 and about 7; whereby that pulp viscosity loss and degradation are substantially avoided.

9. The process of claim 8 wherein said peroxide is hydrogen peroxide.

10. The process of claim 8 wherein said metallic portion is tin.

11. A process for delignifying and brightening lignocellulosic pulp for use in a paper-making process, comprising: forming an aqueous acidic slurry of lignocellulosic pulp having a pulp consistency of 3% to 50% and maintaining the temperature of the pulp slurry between about 40° C. and about 120° C. for a period of between about 0.5 hours and about 8 hours to delignify and brighten the pulp while substantially avoiding pulp viscosity loss and degradation from cellulose oxidation, said pulp slurry consisting essentially of lignocellulosic pulp; from about 0.1% to about 20% by weight, based on O.D. pulp, of peroxide; from about 0.1% to about 10% by weight, based on O.D. pulp, of a tin-containing additive; and sufficient acid to maintain the pH of the pulp slurry between about 1 and about 7; and subsequent thereto adding sufficient base to adjust the pH of the pulp slurry to between about 8 and about 12; and maintaining the temperature of the now alkaline pulp slurry between about 40° C. and 90° C. for a period of between about 0.1 and about 4.0 hours.

12. The process of claim 11 wherein said peroxide is present in said pulp slurry between about 0.5% and 2% by weight based on O.D pulp.

13. The process of claim 11 wherein the pH of said alkaline pulp slurry is maintained between about 9 and about 10.5.

14. The process of claim 11 wherein said peroxide is hydrogen peroxide.

15. The process of claim 11 wherein the tin-containing additive is selected from the group consisting of sodium stannate, stannous chloride, and stannous sulfate.

16. A process for delignifying and brightening lignocellulosic pulp for use in a paper-making process, comprising forming an aqueous acidic slurry of lignocellulosic pulp having a pulp consisting of 3% to 50% and maintaining the temperature of the pulp slurry between about 40° C. and about 120° C. for a period of between about 0.5 hours and about 8 hours to delignify and brighten the pulp while substantially avoiding pulp viscosity loss and degradation from cellulose oxidation, the pulp slurry consisting essentially of lignocellulosic pulp: from about 0.1% to about 20% by weight, based on O.D. pulp, of peroxide; from about 0.1% to about 10% by weight, based on O.D. pulp, of a titanium-containing additive; and sufficient acid to maintain the pH of the pulp slurry between about 1 and about 7.

17. The process of claim 16 wherein the titanium-containing additive is titanium sulfate.

18. A process for delignifying and brightening lignocellulosic pulp for use in a paper-making process, comprising: forming an aqueous acidic slurry of lignocellulosic pulp having a pulp consistency fo 3% to 50% and maintaining the temperature of the pulp slurry between about 40° C. and about 120° C. for a period of between about 0.5 hours and about 8 hours to delignify and brighten the pulp while substantially avoiding pulp viscosity loss and degradation from cellulose oxidation, the pulp slurry consisting essentially of lignocellulosic pulp; from about 0.1% to about 20% by weight, based on O.D. pulp, of peroxide; from about 0.1% to about 10% by weight, based on O.D. pulp, of a titanium-containing additive; and sufficient acid to maintain the pH of the pulp slurry between about 1 and about 7; and subsequent thereto adding sufficient base to adjust the pH of the pulp slurry to between about 8 and about 12; and maintaining the temperature of the now alkaline pulp slurry between about 40° C. and 90° C. for a period of between about 0.1 and about 4.0 hours.

19. The process of claim 18 wherein the titanium-containing additive is titanium sulfate.

20. A process for delignifying and brightening lignocellulosic pulp for use in a paper-making process, comprising forming an aqueous acidic slurry of lignocellulosic pulp having a pulp consistency of 3% to 50% and maintaining the temperature of the pulp slurry between about 40° C. and about 120° C. for a period of between about 0.5 hours and about 8 hours to delignify and brighten the pulp while substantially avoiding pulp viscosity loss and degradation from cellulose oxidation, the pulp slurry consisting essentially of lignocellulosic pulp; from about 0.1% to about 20% by weight, based on O.D. pulp, of peroxide; from about 0.1% to about 10% by weight, based on O.D. pulp, of a vanadium-containing additive; and sufficient acid to maintain the pH of the pulp slurry between about 1 and about 7.

21. The process of claim 20 wherein the vanadium-containing additive is vadadium pentoxide.

22. A process for delignifying and brightening lignocellulosic pulp for use in a paper-making process, comprising: forming an aqueous acidic slurry of lignocellulosic pulp having a pulp consistency of 3% to 50% and maintaining the temperature of the pulp slurry between about 40° C. and about 120° C. for a period of between about 0.5 hours and about 8 hours to delignify and brighten the pulp while substantially avoiding pulp viscosity loss and degradation from cellulose oxidation, the pulp slurry consisting essentially of lignocellulosic pulp; from about 0.1% to about 20% by weight, based on O.D. pulp, of peroxide; from about 0.1% to about 10% by weight, based on O.D. pulp, of a vanadium-containing additive; and sufficient acid to maintain the pH of the pulp slurry between about 1 and about 7; and subsequent thereto adding sufficient base to adjust the pH of the pulp slurry to between about 8 and about 12; and maintaining the temperature of the now alkaline pulp slurry between about 40° C. and 90° C. for a period of between about 0.1 and about 4.0 hours.

23. The process of claim 22 wherein the vanadium-containing additive is vanadium pentoxide.

* * * * *

UNITED STATES PATENT AND TRADEMARK OFFICE

CERTIFICATE OF CORRECTION

PATENT NO. : 4,410,397

DATED : October 18, 1983

INVENTOR(S) : Arthur W. Kempf

It is certified that error appears in the above—identified patent and that said Letters Patent is hereby corrected as shown below:

Abstract, line 1 - "peroxide based" should be -- peroxide-based --;

Abstract, line 2 - "liqnocellulosic pulp" should be -- lignocellulosic pulp --;

Abstract, line 5 - "to a temperature" should be -- at a temperature --;

Abstract, line 12 - "fH" should be -- pH --;

Col. 1, line 15 - "at a peroxide-based" should be -- to a peroxide-based --;

Col. 1, line 45 - "procedure" should be -- procedures --;

Col. 1, line 54 - "paper making" should be -- paper-making --;

UNITED STATES PATENT AND TRADEMARK OFFICE

CERTIFICATE OF CORRECTION

PATENT NO. : 4,410,397

DATED : October 18, 1983

INVENTOR(S) : Arthur W. Kempf

It is certified that error appears in the above—identified patent and that said Letters Patent is hereby corrected as shown below:

| | | |
|---|---|---|
| Col. 2, line 44 | - | "Tappi" should be -- Tappi --; |
| Col. 3, line 7 | - | "paper making" should be -- paper-making --; |
| Col. 3, line 40 | - | Delete -- , -- after "with the"; |
| Col. 3, line 65 | - | Add -- , -- after "120° C"; |
| Col. 3, line 66 | - | Add -- , -- after "100° C"; |
| Col. 5, line 39 | - | Add -- , -- after "oxygen-bleached"; |
| Col. 5, line 51 | - | Add -- , -- after "oxygen-bleached"; |
| Col. 7, line 35 | - | Add -- , -- after "compound"; |
| Col. 7, line 35 | - | Add -- , -- after "weight"; |
| Col. 8, line 1 | - | "hereinabove" should be -- hereinbefore --; |
| Col. 9, line 36 | - | "O.D" should be -- O.D. --; |

Signed and Sealed this

*Twenty-first* Day of *August 1984*

[SEAL]

*Attest:*

GERALD J. MOSSINGHOFF

*Attesting Officer*

*Commissioner of Patents and Trademarks*